United States Patent [19]

McCord

[11] Patent Number: 4,618,263

[45] Date of Patent: Oct. 21, 1986

[54] SOUND SUPPRESSOR IN A LIQUID MEDIUM

[76] Inventor: James W. McCord, 9101 Northingham Pkwy., Louisville, Ky. 40222

[21] Appl. No.: 670,865

[22] Filed: Nov. 13, 1984

Related U.S. Application Data

[63] Continuation-in-part of Ser. No. 421,077, Sep. 22, 1982, abandoned.

[51] Int. Cl.[4] ..... B01F 11/02

[52] U.S. Cl. ..... 366/127; 134/184

[58] Field of Search ..... 134/105, 184; 181/200, 181/202, 205, 198; 210/319; 366/127

[56] References Cited

U.S. PATENT DOCUMENTS 2,564,814 8/1951 Perrin .
4,224,110 9/1980 McCord ..... 134/184

FOREIGN PATENT DOCUMENTS 1138321 6/1957 France ..... 34/77
745562 6/1980 U.S.S.R. ..... 134/184

*Primary Examiner*—Larry I. Schwartz
*Attorney, Agent, or Firm*—Charles G. Lamb

[57] ABSTRACT

A solution cavitation creating device is located within a chamber having a liquid solution therein to create cavitation and a sound reflecting and suppression structure is located within the chamber to quiet the cavitation in the chamber and reflect the wave form into the liquid solution.

7 Claims, 6 Drawing Figures

SOUND SUPPRESSOR IN A LIQUID MEDIUM

This application is a continuation-in-part of Ser. No. 421,077, filed Sept. 22, 1982, now abandoned.

BACKGROUND OF THE INVENTION (1) Field of the Invention

This invention relates to an apparatus for cavitating a liquid and reflecting and suppressing the sound waves generated therefrom. More particularly, the present invention relates to an apparatus for vaporizing a liquid solution in combination with sonic agitating means. Even more particularly, the present invention relates to an apparatus of the class described above including cavitation creating means located in the vaporizing apparatus and sound reflecting and suppression means functionally associated with cavitation creating means.

(2) Description of the Prior Art

In the cleaning of hard to clean objects, boiling a cleaning solution has been utilized in the removal of the undesirable material therefrom. The cleaning of objects, such as tools, manufactured parts, and the like, is accomplished by immersing the objects into a hot, boiling cleaning solution. In some of these apparatus, cavitation creating devices are used in the liquid portion to create cavitation in the solution which provides a scrubbing action to aid in cleaning hard to clean objects.

SUMMARY OF THE INVENTION

It is an object of the present invention to provide an apparatus for agitating a liquid including cavitation generating means and a sound reflecting and suppression structure to provide for quiet operation and simultaneously therewith, reflect the generated sound waves back into the solution.

It is a further object of the invention in an apparatus for vaporizing a liquid solution, condensing the vaporized solution, and returning the condensed solution to the vaporizing section of the apparatus for reuse to provide a cavitation creating device in the vaporizing section with sound attenuation means for quiet operation whereby means are provided to reflect the waves created by the cavitation means back into the solution and those waves that are not reflected are suppressed or absorbed.

It is even a further object to improve the efficiency of cavitation means in a vapor cleaning apparatus by including means to improve the reflection of cavitating waves back into a cleaning liquid.

More particularly, the present invention provides an apparatus for agitating a liquid comprising a housing defining at least one chamber for containing a liquid, cavitation generating means disposed within said at least one chamber for agitating the liquid contained in said at least one chamber, wave reflecting means disposed within said at least one chamber, said wave reflecting means including reflecting surface means located to reflect waves from generally the margin of said at least one chamber back into the body of the liquid contained in said at least one chamber to reinforce cavitation of the liquid in the chamber created by the cavitation generating means as the energy of the reflected waves is dissipated in the liquid, and sound suppression means disposed within said at least one chamber between said wave reflecting means and at least one wall of said at least one chamber to suppress or absorb the waves not reflected back into the liquid in the at least one chamber by the wave reflecting means.

It is to be understood that the description of the examples of the present invention given hereinafter is not by way of limitation and various modifications within the scope of the present invention will occur to those skilled in the art upon reading the disclosure set forth hereinafter.

BRIEF DESCRIPTION OF DRAWINGS

These and other objects and features of the present invention will become even more clear upon reference to the following description and in conjunction with the accompanying drawings wherein like numbers refer to the like parts throughout and in which.

DESCRIPTION OF THE PREFERRED EMBODIMENTS

Figure 1:
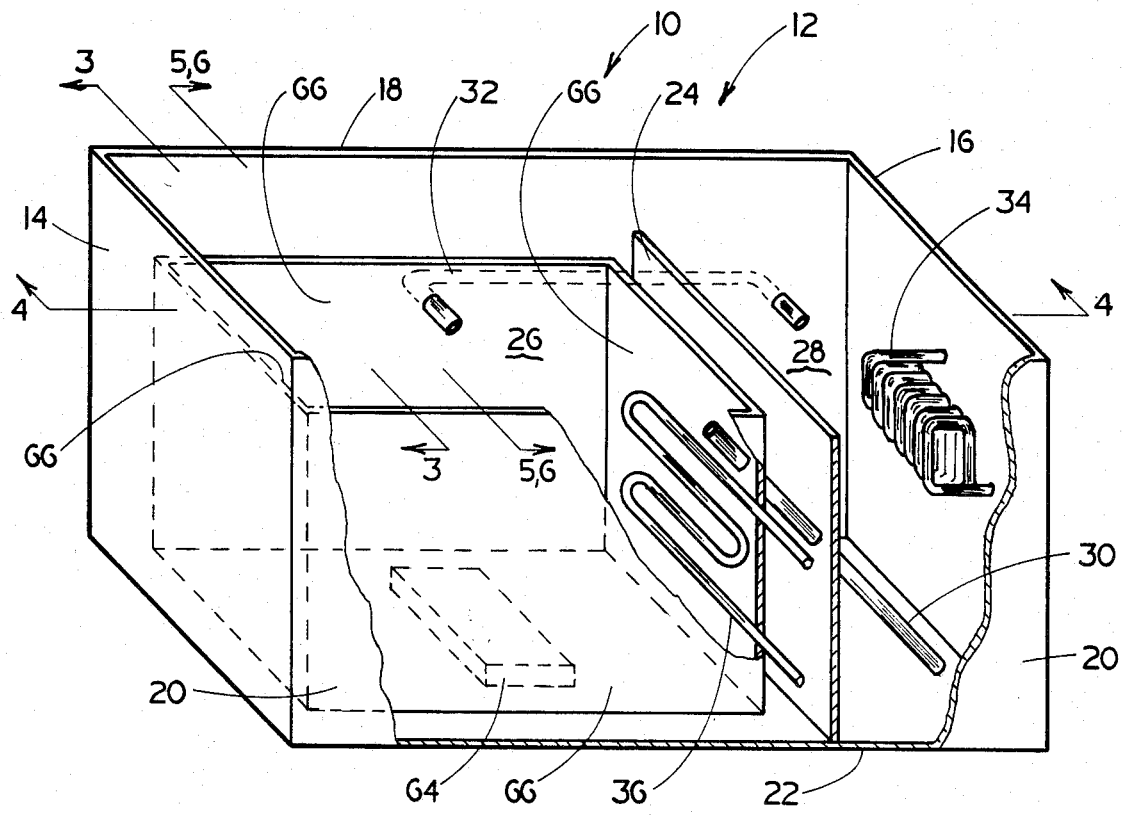
FIG. 1 is a perspective view of an apparatus, partially broken away, incorporating one preferred embodiment of the present invention.

FIG. 1 illustrates a vapor generating and recovery apparatus, generally denoted by the number 10, comprising a housing 12 having two end walls 14 and 16, two side walls 18 and 20, and a bottom wall 22. However, it is realized that even though the invention is described in relating to a vapor generating and recovery apparatus, it is intended that this invention may be used at ambient conditions. A weir 24 is disposed within the housing 12 spanning the distance between the side walls 18 and 10 dividing the housing interior into a vaporizing chamber 26 and a condensing chamber 28.

The condensing chamber 28 is in fluid flow communication with the vaporizing chamber 26 by means of conduits 30 and 32. The conduit 30 is shown angularly disposed to the vertical with its lower end (inlet end) near the bottom of the condensing chamber 28, and its upper end (outlet end) at a preselected position below the upper extremity of the weir 24 and above the desired operating level of the liquid solution in the vaporizing chamber 26. As illustrated in FIG. 1, the conduit 30 extends through the weir 24, but it should be understood that the conduit 30 may extend outside the housing 12 between the condensing chamber 28 and vaporizing chamber 26. The conduit 32 is positioned substantially horizontally and is shown as extending outside the housing 12 around the weir 24. However, the conduit 32 may extend through weir 24 as vertical positioning of the inlet end in the condensing chamber 28, and outlet end in the vaporizing chamber 26 are the critical factors. The inlet and outlet ends of the conduit 32 are at a selected position above the outlet end of the conduit 30 and below the upper extremity of the weir 24.

In operating of apparatus 10, when the level of the heavier component of the condensed solution in the condensing chamber 32 reaches a level equal to the level of the outlet end of the conduit 30, the heavier liquid component flows from the condensing chamber 28 to the vaporizing chamber 26 through the conduit 30. Also, since the lighter component of the condensed solution is on top of the heavier component, when the total condensate level in the condensing chamber 28 reaches the level of the conduit 32, the lighter component then flows from the condensing chamber 28 into the vaporizing chamber 26 through the conduit 32.

The apparatus 10 includes vapor condensing means 34 for condensing the solution vapor in the condensing chamber 28, and liquid solution vaporizing means 36 for vaporizing the solution contained in the vaporizing chamber 26. As shown, the vapor condensing means 34 is a refrigeration evaporator coil of a refrigeration system (see FIG. 2), generally denoted as the number 38, and the condensate vaporizing means 36 is a refrigerant condensing coil of the same refrigerant system 38. The vapor condensing coil 34 maintains a preselected temperature in the condensing chamber 28 below the vaporizing temperature of the liquid solution thereby condensing the solution vapor into the condensing chamber 28 and preventing the escape of the vapor from housing 12. The condensed vaporizing coil 36 provides sufficient heat to vaporize the liquid condensate in the vaporizing chamber 26. As illustrated, the condensate vaporizing coil 36 is located adjacent the weir 24 below the upper extremity of the weir in the vaporizing chamber 26 and the vapor condensing coil 34 is located adjacent the end wall 16 of the housing 12 across the condensing chamber 28 from the weir 24. The vapor condensing chamber coil 34 has at least a portion thereof located below the upper extremity of the weir 24.

It should be understood that if the apparatus 10 has more than one condensate vaporizing chamber, additional condensate vaporizing coils (refrigerant condensing coils) can be included in the refrigerant system 38, for example, in parallel with the condensate vaporizing coil 36. Similarly, if additional vapor condensing coils (refrigerant evaporator coils) are required, they can be included in the refrigerant system 38, for example in parallel with the vapor condensing coil 34 with appropriate refrigerant expansion valves.

Figure 2:
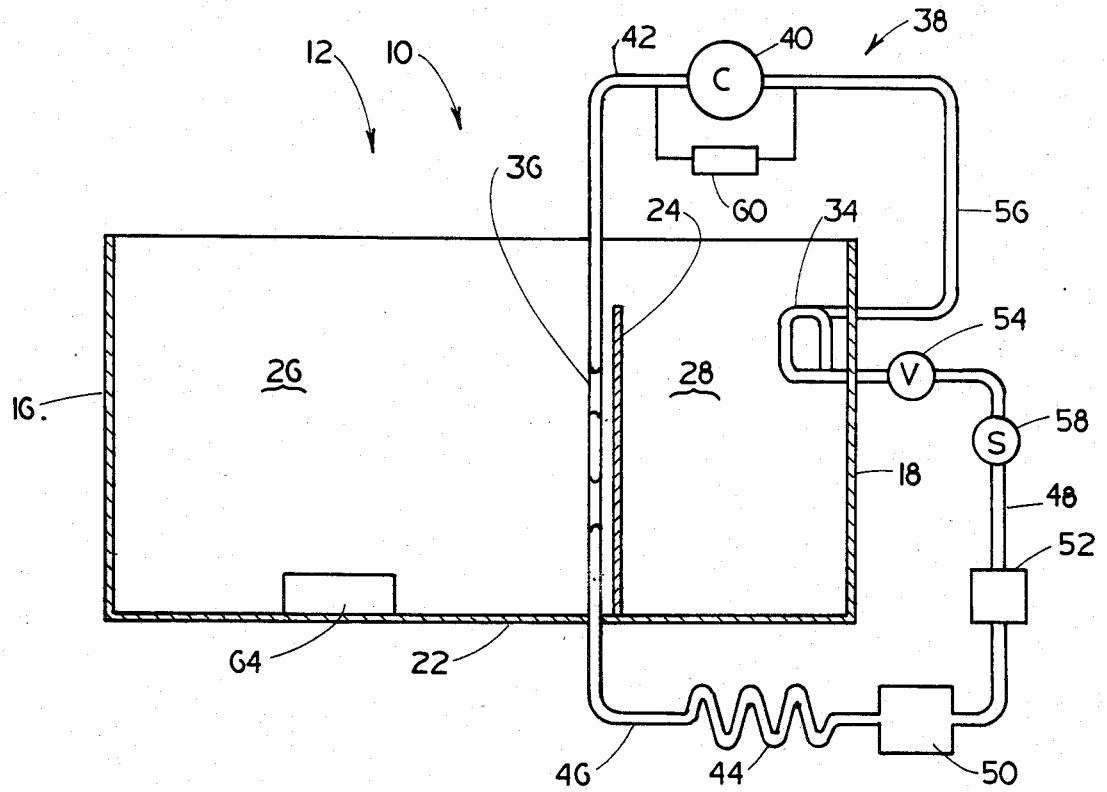
FIG. 2 is a cross-sectional side view of the apparatus of FIG. 1 including a schematic representation of a refrigerant system.

FIG. 2 illustrates the refrigerant system 38 as comprising a refrigerant compressor 40 for compressing a suitable refrigerant. The high pressure side of the refrigerant compressor 40 is in refrigerant flow communication with the refrigerant condensing coil (condensate vaporizing coil 36) through a refrigerant gas conduit 42. A complimentary refrigerant condensing coil 44 physically located outside of the housing 12 is positioned downstream of the refrigerant condensing coil 36 and is in refrigerant flow communication with the refrigerant condensing coil 36 through a refrigerant conduit 46. The refrigerant evaporator coil (vapor condensing coil 34) is located downstream of the complimentary refrigerant condensing coil 44 and is in refrigerant flow communication with the refrigerant complementary condensing coil 44 and the refrigerant evaporator coil 34. Gaseous refrigerant from the refrigerant evaporator coil 34 returns to the low pressure side of the compressor 40 through an appropriate refrigerant gas conduit 56.

A refrigerant system pump down feature is also incorporated in the refrigerant system 38 for pumping refrigerant from the refrigerant evaporator coil 34 and the compressor 40 when the refrigerant system is to be deactivated. The pump down feature comprises a solenoid operated pump down valve 58 located in the refrigerant conduit 48 upstream of the thermo expansion valve 54, and a refrigerant pressure sensing device 60 which measures the refrigerant pressure differential across the compressor 40 and which is operatively associated with the compressor to shut the compressor off when the pump down valve is closed and the refrigerant pressure drop reaches a predetermined minimum.

The complementary condensing coil 44 is utilized to remove excess heat from the system. The complimentary condensing can be air or water cooled, and is activated in response to a temperature sensing device located in the vapor zone of the condensing chamber 28 to operate when the temperature of the vapor to be condensed in the condensing chamber exceeds a preselected temperature. It is also contemplated that the complimentary condensing coil 44 can be activated in response to the pressure of the refrigerant at the low pressure or high pressure side of the refrigerant compressor 40.

The vapor generating and recovery apparatus 10 further comprises means for agitating the condensate in the vaporizing chamber 26. Preferably, the agitating means comprises cavitation generating means such as an ultrasonic transducer 64 which is activated by an ultrasonic generator (not shown). The transducer 64 provides vibrations which agitates the boiling liquid condensate in the vaporizing chamber 26 thereby providing a scrubbing action to remove hard to clean material from the objects to be cleaned.

In order to provide for efficient utilization of the vibrating waves by continually reflecting the waves back into the liquid and to obtain a quiet operation of the vapor generating and recovery apparatus 10, sonic reflecting and suppressing or absorbing means is associated with the housing 12 to reflect sound waves back into the liquid and to at least lessen sound transmission of waves not reflected to the outside of the housing.

FIG. 1 shows the ultra sonic generating transducer 64 located at floor 22 of the housing 12 in the vaporizing chamber 26. The sound reflecting and suppressing means includes relatively rigid wave reflecting material 66 located in the vaporizing chamber 26 adjacent to each of the housing walls 14, 18, and 20; and weir 24. Thus, the vaporizing chamber 26 is surround by wave reflecting surfaces. The surfaces reflect waves generated by the transducer 64 generally from the margin of the vaporizing chamber back into the body of the liquid contained in the vaporizing chamber. The reflected waves are not only thus prevented from migrating to the exterior or the housing 12, but also reinforce the cavitation of the liquid contained in the housing 12 created by the transducer 64 as the energy of the wave form is dissipated into the liquid. The relatively rigid reflecting material should not chemically react with the condensate in the vaporizing chamber. Examples of some suitable materials having a broad spectrum of use are stainless steel, glass and ceramic.

Figure 3:
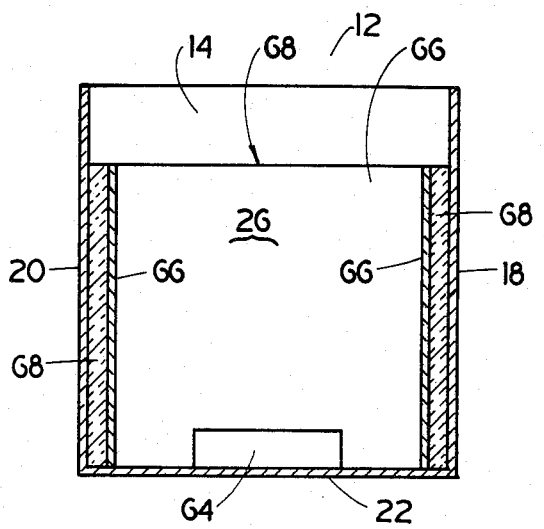
FIG. 3 is a cross-sectional end view taken in the direction of arrows 3—3 in FIG. 1 including another preferred embodiment of the present invention.

In addition to the wave reflecting material, a sound absorbing or suppressing material is incorporated between the reflecting material and the walls of the chamber. As shown in FIG. 3, the reflection sheets 66 are disposed in adjoining relationship to the walls of the housing 12 and a layer of sound absorbing material 68 is disposed between the reflecting sheets 66 and adjoining housing walls 14, 18, 22, and weir 24. Examples of some suitable sound absorbing materials are open or closed cell foam, wood, plastics and glass fiber.

Figure 4:
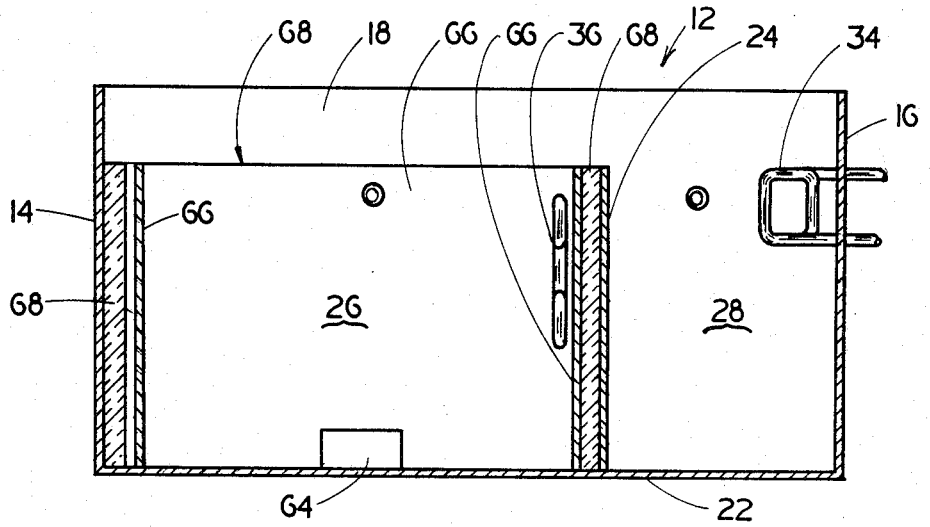
FIG. 4 is a cross-sectional side view taken in the direction of arrows 4—4 in FIG. 1 including a further preferred embodiment of the present invention.

FIG. 4 illustrates the ultrasonic generating transducer 64 mounted to the bottom wall 22 of the vaporizing chamber 26. As shown, a sheet of sound reflecting material 66 is located in adjoining relationship to at least the wall of the vaporizing chamber 26 surrounding the transducer 64. In addition sound absorbing or suppressing material 68 is shown between the sheet of reflecting material 66 and the walls of chamber 26.

Figure 5:
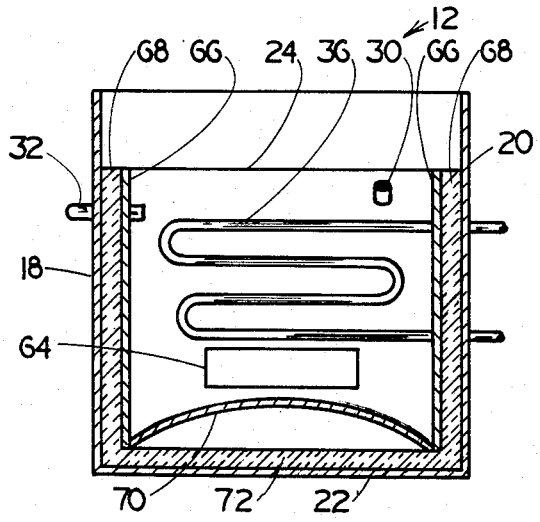
FIG. 5 is a cross-sectional end view taken in the direction of arrows 5—5 in FIG. 1 including a still further preferred embodiment of the present invention.

FIG. 5 illustrates a cross-sectional view of the vaporizing chamber 26 also having the ultrasonic generating transducer 64 mounted therein. As shown, wave reflecting sheets 66 and sound absorbing materials 68 are located in adjoining relationship to the exterior walls of the vaporizing chamber 26, for example, the walls 14, 18 and 20 of the housing 10, the sound absorbing material 68 being disposed between the reflecting sheets 66 and the adjoining housing walls 14, 18 and 20. Further, a sheet of reflecting material 70 is disposed in adjoining relationship to the bottom wall 22 of the housing 10 in the vaporizing chamber 26, and a layer of sound absorbing material 72 disposed between the reflecting sheet 70 and the housing bottom wall 22. The reflecting sheet 70 adjoining the housing bottom wall 22 can be planar or curved or any other preferred geometric configuration. As shown in FIG. 5, the reflecting sheet 70 is curved and oriented to present a convex sonic reflecting surface to the vaporizing chamber 26.

Figure 6:
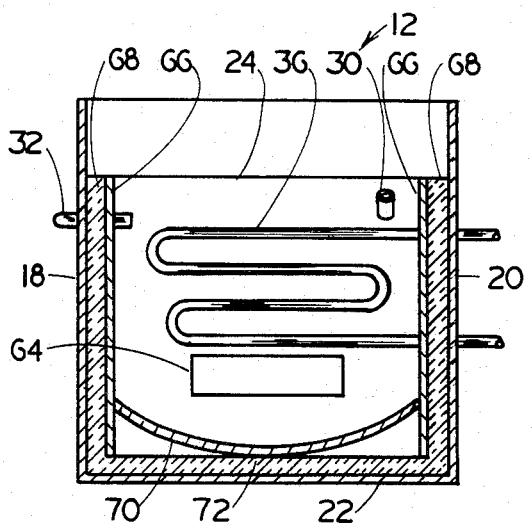
FIG. 6 is a cross-sectional end view taken in the direction of arrows 6—6 in FIG. 1 including yet a further preferred embodiment of the present invention.

FIG. 6 is a cross-sectional view of the vaporizing chamber 26 similar in every respect to the embodiment of FIG. 5, discussed immediately above, except that the curved reflecting sheet 70 is oriented to present a concave reflecting surface to the vaporizing chamber 26.

It should be clearly understood that the present invention contemplates that the number and combination of vaporizing chamber walls which have adjoining sound suppressing means, that whether or not the vaporizing chamber bottom wall is to have adjoining sound suppression means, and that whether or not the sound suppression means in combination with wave reflecting sheets is a criterion which will vary to comply with different requirements of the work place in which the apparatus 10 is to be used.

The foregoing detailed description and accompanying Figures are given primarily for clearness of understanding and no unnecessary limitations are to be understood therefrom for modifications will become obvious to one skilled in the art upon reading this disclosure and may be made without departing from the spirit of the invention and scope of the claims.

It will be realized that various changes may be made to the specific embodiments shown and described herein without departing from the principals and spirit of the present invention.

What is claimed is:

1. An apparatus for agitating a liquid comprising:

a housing defining at least one chamber for containing the liquid;

cavitation generating means disposed within said at least one chamber for agitating the liquid contained in said at least one chamber;

wave reflecting means disposed within said at least one chamber, said wave reflecting means including reflecting surface means located to reflect waves from generally the margin of said at least one chamber back into the body of the liquid contained in said at least one chamber to reinforce cavitation of the liquid in the chamber created by the cavitation generating means as the energy of the reflected waves is disipated in the liquid;

sound suppressing, means disposed between said wave reflecting means and at least one wall of said at least one chamber to suppress or absorb the waves not reflected back into the liquid in the at least one chamber by the wave reflecting means.

2. The apparatus of claim 1, wherein said wave reflecting surface means comprises a sheet of reflecting material disposed in adjoining relationship to at least one wall of said housing.

3. The apparatus of claim 1, wherein said wave reflecting surface means further comprises a sheet of reflecting material disposed in adjoining relationship to the bottom wall of said housing in said at least one chamber.

4. The apparatus of claim 3, wherein said sheet of reflecting material adjoining the bottom wall of said housing presents a curved reflecting surface to the vaporizing chamber.

5. The apparatus of claim 4, wherein said curved reflecting surface is generally convex.

6. A vapor generating and recovery apparatus comprising:

a housing;

means dividing the interior of said housing into at least two chambers for containing a liquid;

heat emitting means disposed in at least one of said chamber for vaporizing a liquid contained therein;

heat absorbing means disposed in at least one of said chambers for condensing vapor into said at least one chamber;

means for transferring condensate from one chamber to the other of said at least two chambers;

cavitation generating means disposed within at least one of said chambers for agitating the liquid contained therein;

wave reflecting means disposed within said at least one chamber having said cavitation generating means, said wave reflecting means including reflecting surface means located to reflect wave from generally the margin of said at least one chamber back into the body of the liquid contained therein; and sound suppressing means disposed between said wave reflection means and at least one wall of said at least one chamber.

7. The vapor generating and recovery apparatus of claim 6 further comprising:

a refrigerant system;

said means for condensing vapor being a refrigerant evaporator coil of said refrigerant sysytem; and said means for vaporizing liquid being a refrigerant condensing coil of said refrigerant system.

* * * * *